US008431852B2

(12) United States Patent
Maruyama et al.

(10) Patent No.: US 8,431,852 B2
(45) Date of Patent: Apr. 30, 2013

(54) KEY SWITCH DEVICE

(75) Inventors: Junichi Maruyama, Shinagawa (JP); Hiromi Otsuka, Shinagawa (JP); Kazuya Yoshimatsu, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 235 days.

(21) Appl. No.: 12/879,797

(22) Filed: Sep. 10, 2010

(65) Prior Publication Data

US 2011/0056818 A1 Mar. 10, 2011

(30) Foreign Application Priority Data

Sep. 10, 2009 (JP) ..... 2009-209464

(51) Int. Cl.
*H01H 13/70* (2006.01)

(52) U.S. Cl.
USPC ..... 200/344; 200/5 A; 200/302.2

(58) Field of Classification Search ..... 200/5 A, 200/517, 302.1, 302.2, 341–345; 400/490–496; 341/22; 345/168, 169
See application file for complete search history.

(56) References Cited

U.S. PATENT DOCUMENTS

| | | | | |
|---|---|---|---|---|
| 4,571,466 | A * | 2/1986 | Iida | 200/5 A |
| 5,219,067 | A * | 6/1993 | Lima et al. | 200/302.2 |
| 5,799,772 | A * | 9/1998 | Sanda et al. | 200/344 |
| 6,273,623 | B1 * | 8/2001 | Chao | 400/472 |
| 6,437,267 | B1 * | 8/2002 | Imai | 200/302.1 |
| 6,861,603 | B1 * | 3/2005 | Wang | 200/344 |
| 6,880,995 | B2 * | 4/2005 | Cheng | 400/491.2 |
| 6,940,031 | B2 * | 9/2005 | Uehira | 200/344 |
| 7,230,195 | B2 * | 6/2007 | Ohnishi | 200/302.1 |
| 7,462,796 | B1 * | 12/2008 | Chai | 200/341 |

FOREIGN PATENT DOCUMENTS

JP 2003-31067 1/2003

* cited by examiner

*Primary Examiner* — Michael Friedhofer
(74) *Attorney, Agent, or Firm* — Staas & Halsey LLP

(57) ABSTRACT

A key switch device and a keyboard, capable of preventing key-entry noise from rebounding and having a drip-proof effect so as to avoid a contact fault and/or insulation failure. The key switch device includes a switch panel; a key top positioned above the switch panel; a pair of link members positioned between the key top and the switch panel and adapted to interlock with the key top so that the key top may be moved in a vertical direction while maintaining a horizontal posture; and an annular elastic wall member positioned between the switch panel and a membrane sheet and configured to contact opposing surfaces of the switch panel and the membrane sheet, wherein the elastic wall member is arranged along a contour of the key top.

7 Claims, 7 Drawing Sheets

KEY SWITCH DEVICE

RELATED APPLICATIONS

The present application claims priority from Japanese Patent Application No. 2009-209464, filed on Sep. 10, 2009, the entire content of which is fully incorporated herein by reference.

BACKGROUND OF THE INVENTION

1. Field of the Invention

The present invention relates to a key switch device and a keyboard wherein a key top is moved up and down relative to a switch panel due to a structural interlock between a pair of link members and the key top.

2. Description of the Related Art

Generally, in a key switch device having a switch mechanism adapted to close or open a contact of an electric circuit due to up-and-down motion (or vertical motion) of a key top, the key top is supported by a pair of link members so as to be moved up and down. There are various types of link members. For example, in a gear link-type, a pair of link members are assembled together into a reverse V-shape as seen laterally and meshed at toothed end regions formed on one end thereof (Japanese Unexamined Patent Publication No. 2003-31067). In a pantograph type, a pair of link members are assembled together into an X-shape as seen laterally and coupled at an intersection so that each link member may rotate or slide relative to each other. The key top may be pressed while a surface of the key top is parallel to a base plate due to interlock between each of the pair of link members. When the key top reaches a lowermost position in an up-and-down stroke thereof, the pair of link members lie under the key top, and when the key top reaches a uppermost position in up-and-down stroke thereof, the pair of link members are raised so as to represent a reverse V-shape or X-shape as seen laterally.

Japanese Unexamined Patent Publication No. 2003-31067, paragraph [0020] explains the configuration of the key switch device. Concretely, it is described that "key switch device 10 has a base 12; a key top 14 having an operation surface 14*a* to which an operator may carry out key-entry operation, the key top being positioned on surface 12*a* of base 12 so as to be moved in up-and-down direction; a pair of link members 16 adapted to guide and support key top 14 on base 12 in the up-and-down direction; and a switch mechanism 18 adapted to close and open a contact of an electric circuit corresponding to the motion of key top 14 in the up-and-down direction."

Japanese Unexamined Patent Publication No. 2003-31067, paragraph [0077] explains the configuration of the key switch device for reducing noise due to an up and down motion of the key top. Concretely, it is described that "in key switch device 110, a pair of assist-support piece 118 may be arranged on base 112 in order to assist the motion of a pair of link member 74 (FIG. 16). Each assist-support piece 118 is arranged at generally an intermediate position between a pair of sliding-engagement portions 114 so as to obliquely project from major surface 112*a* of base 112, and positioned so that a free end of each assist-support piece 118 opposes each other. Similarly to upright plate portion 114*a* of sliding-engagement portion 114, assist-support piece 118 may be integrally formed with base 112 by punching a profile of assist-support piece 118 at a predetermined place of base 112 by means of a press machine or the like, and bending the punched portion toward the side of major surface 112*a*. Each assist-support piece 118 projects above sheet member 58 through a hole (not shown) formed in sheet substrates 50 of membrane sheet 52 and sheet member 58."

Further, Japanese Unexamined Patent Publication No. 2003-31067, paragraph [0078] explains the function of the pair of assist-support piece 118. Concretely, it is described that "the top surface of a pair of assist-support piece 118 slidably contacts the lower surface of coupling part 82 of link member 74 in the whole up-and-down stroke of key top 72. To this end, each assist-support piece 118 has a meander shape corresponding to the trajectory of movement of coupling part 82 of link member 74. Due to this, the bumpy motion of link member 74, which may occur during the key-entry operation of key top 72, may be effectively reduced and the bumpy motion of key top 72 and noise therefrom may be reduced as possible."

In the conventional key switch device, it is intended to reduce sound due to the up and down motion of the key top supported by the pair of link members (so-called "chattering noise"). However, it is not intended to reduce "key-entry noise," which occurs when the operation surface of the key top is relatively strongly pressed by a finger. In this regard, the "key-entry noise" means operation noise which occurs when impact at the time of pressing the key top reaches the base (or switch panel) and rebounds from a membrane sheet or a metal support panel. It has been found that the rebound of the key-entry noise is caused by a gap between the switch panel and the membrane sheet, and/or a gap between the membrane sheet and the support panel.

Generally, in order to integrally stack the switch panel, the membrane sheet and the support panel, a plurality of pins projecting from the back side of the resin switch panel pass through a hole of the membrane sheet and the support panel from the front side of the membrane sheet to the back side of the support panel, and the front end of the pin exposed from the hole is heated and melt on the back side of the support panel. The pins are integrated with the stacked panel/sheet while positioning the switch panel, the membrane sheet and the support panel in a horizontal direction, and located at a periphery of the key top. In a keyboard having a plurality of key switch devices, each pin is positioned between the neighboring key switch devices. Although the stacked panel/sheet does not have a gap near the pin, a gap exists between the upper stack and the lower stack in an area which does not includes the pin.

Although the number of the pins may be increased in order to minimize the gap, there is a structural restriction in this case. Although it may be possible to bond boundary surfaces of the upper and lower stacks by adhesive, the positional accuracy between each layer may be deteriorated. In order to reduce the key-entry noise, soft material may be used for the switch panel and/or an impact absorbing sheet may be used. However, when the switch panel is made from soft material, the manufacturing cost of the switch panel is increased and the dimensional stability thereof is deteriorated. On the other hand, when the impact absorbing sheet is used, the thickness of the key switch device and the keyboard is increased, resulting in that a desired specification for the key switch device or the keyboard cannot be satisfied.

Further, in the conventional key switch device, when liquid is dropped on the device, the liquid may enter a gap between the switch panel and the membrane sheet, the liquid may spread on a boundary surface between the switch panel and the membrane sheet by capillary action, and then the liquid may enter an air vent of the membrane sheet. If the liquid enters the air vent, the liquid may reach the contact of the electric circuit, resulting in contact fault. Further, if the liquid enters within a housing of the keyboard, insulation failure may occur.

In addition, in a key switch device having a rubber dome (or an actuating member) adapted to close a contact of the membrane sheet as the key top is lowered, the switch panel is stacked on the membrane sheet after the rubber dome is bonded to the membrane sheet by adhesive. Therefore, when the positional accuracy of the rubber dome is not good, the positioning of the rubber dome and the switch panel cannot be accurately carried out.

Some of the types of adhesive used to bond the rubber dome to the membrane sheet have poor oil resistance. Although adhesive including fluoro-silicon (fluorinated silicon) having high oil resistance may be used, the cost of fluoro-silicon is high.

SUMMARY OF THE INVENTION

It is an object of the present invention to provide a key switch device and a keyboard, capable of preventing the key-entry noise from rebounding and spreading around, and having drip-proof effect to avoid the contact fault and/or the insulation failure.

It is another object of the present invention to provide a key switch device and a keyboard, capable of being used in oily environment without problems, wherein positioning of the actuating member (or the rubber dome) and the switch panel may be easily carried out.

Therefore, according to the present invention, there is provided a key switch device comprising: a switch panel having an opening; a key top positioned above the switch panel; a pair of link members positioned between the key top and the switch panel and adapted to support the key top so that the key top may be moved in a vertical direction while maintaining a horizontal posture; a membrane sheet positioned below the switch panel and adapted to close and open a contact of an electric circuit corresponding to the vertical motion of the key top; an actuating member positioned between the membrane sheet and the key top and adapted to close the contact corresponding to the downward motion of the key top; and an annular elastic wall member positioned between the switch panel and the membrane sheet and configured to contact opposing surfaces of the switch panel and the membrane sheet, wherein the elastic wall member is arranged along a contour of the key top.

In one embodiment, the switch panel has a groove on the surface opposing the membrane sheet, and the groove is adapted to engage the elastic wall member.

In one embodiment, the elastic wall member is formed by screen printing.

In one embodiment, the actuating member has a peripheral groove formed at a peripheral wall thereof, and the actuating member is attached to the switch panel by engaging the peripheral groove with an open end which delimits the opening of the switch panel.

In one embodiment, the key switch device further comprises a frame-like wall arranged around the key top, the frame-like wall having an inner surface adapted to contact an outer lateral surface of the key top.

According to the present invention, there is provided a key board having a plurality of key switch devices of the invention.

BRIEF DESCRIPTION OF THE DRAWINGS

The above and other objects, features and advantages of the present invention will become more apparent from the following description of preferred embodiments in connection with the accompanying drawings, wherein.

DESCRIPTION OF THE PREFERRED EMBODIMENT

Although the key switch device of the invention may be independently used, it is preferable that a plurality of key switch devices of the invention are used in a keyboard for a personal computer, such as a laptop computer or a palmtop computer. The key switch device has a switch panel having an opening at the center thereof; a key top positioned above the switch panel; a pair of link members positioned between the key top and the switch panel and adapted to support the key top so that the key top may be moved in a vertical direction while maintaining a horizontal posture; a membrane sheet positioned below the switch panel and adapted to close and open a contact of an electric circuit corresponding to the vertical motion of the key top; an actuating member positioned between the membrane sheet and the key top and adapted to close the contact corresponding to the downward motion of the key top; and an elastic wall member positioned between the switch panel and the membrane sheet and configured to contact opposing surfaces of the switch panel and the membrane sheet in a compressed manner, wherein the elastic wall member is arranged along a contour of the key top. In the invention, due to the elastic wall member, the key-entry noise generated by key-entry operation to the key top is prevented from spreading around, the key-entry noise is prevented from rebounding between the switch panel and the membrane sheet, and liquid is prevented from entering an inner area of the wall member, whereby trouble of the contact of the membrane sheet due to liquid is avoided.

As the pair of the link members, a gear-link-type or a pantograph-link-type may be used. However, other link members may be used. In a gear-link-type, at an intersection of the reverse V-shape as seen in a lateral direction, a tooth of one link member engages a tooth of another link member so that each link member may rotate relative to each other. In a pantograph-link-type, a pair of link members are assembled together into an X-shape as seen in the lateral direction, and each link member may rotate relative to each other at an intersection thereof. Regarding the actuating member, a fixing manner thereof is not limited. However, a lower end of the actuating member may be bonded to the membrane sheet by adhesive, or the actuating member may be engaged with an open end which delimits the opening of the switch panel. Further, the actuating member may be formed as a portion of the rubber sheet.

The embodiments of the present invention are described below in detail, with reference to the accompanying drawings.

Figure 1:
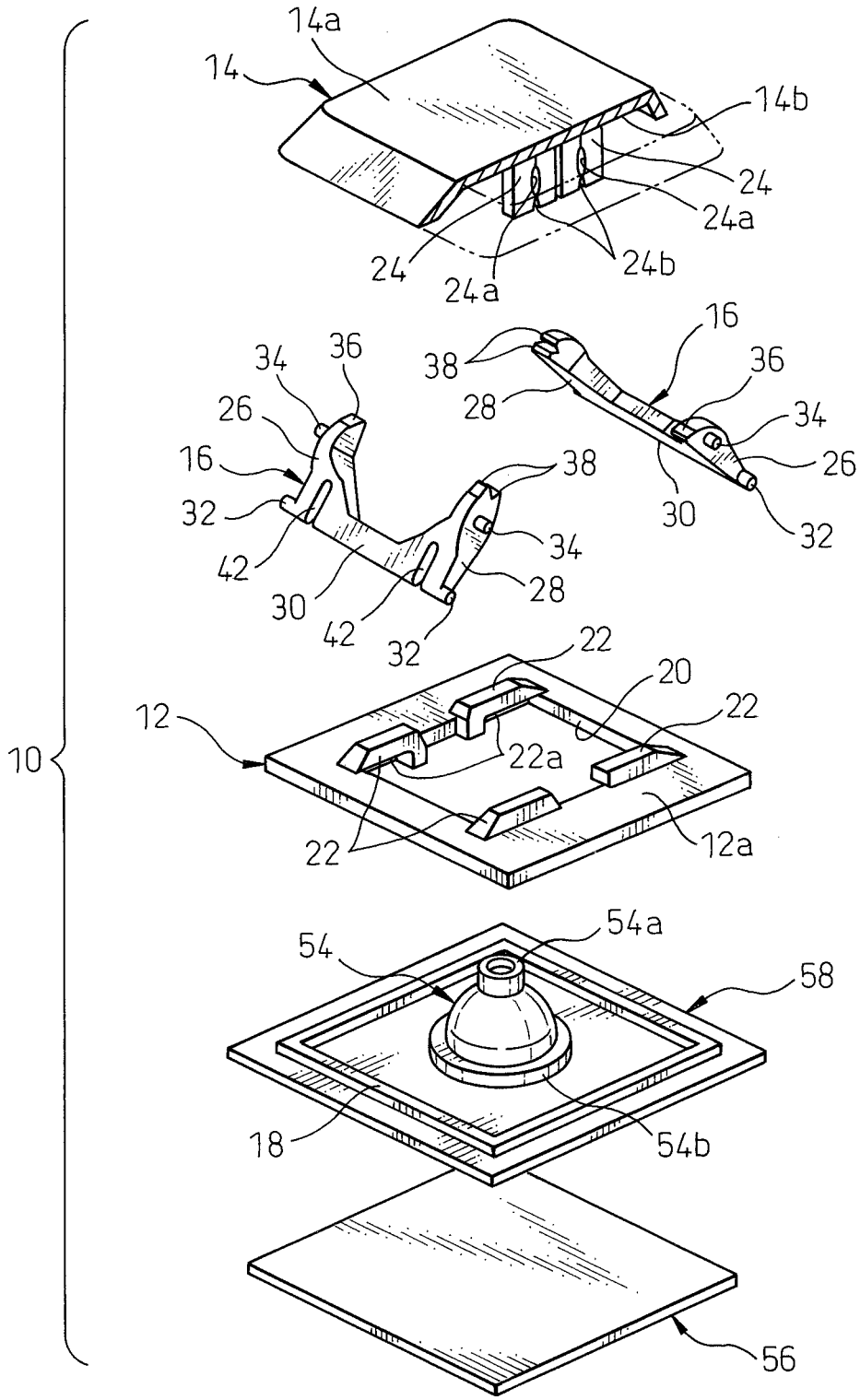
FIG. 1 is an exploded perspective view showing a key switch device according to a first embodiment of the present invention.
Figure 2:
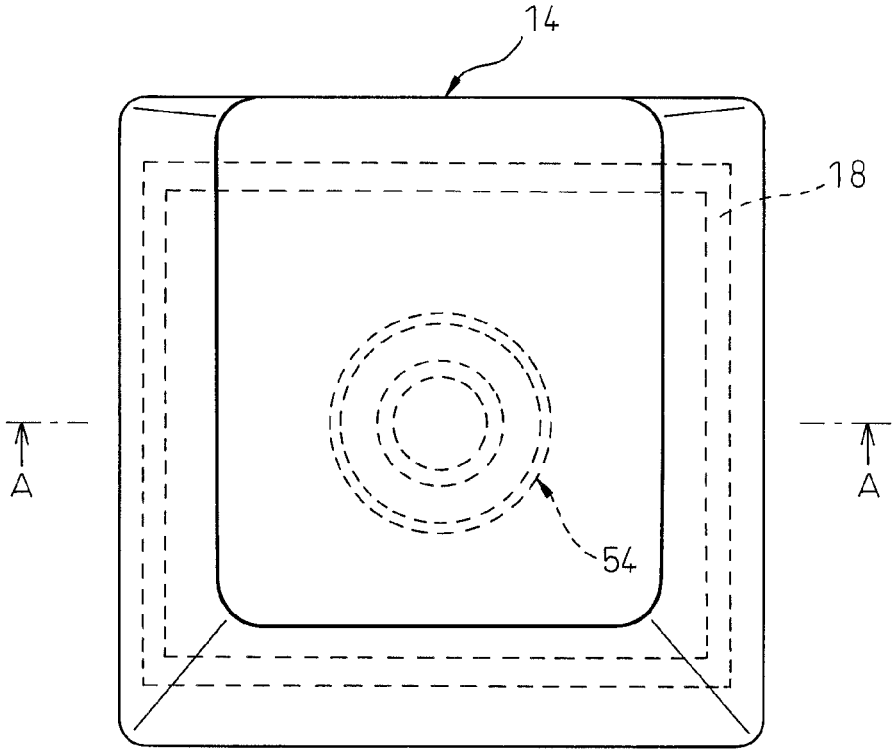
FIG. 2 is a plane view of the key switch device of FIG. 1.
Figure 3:
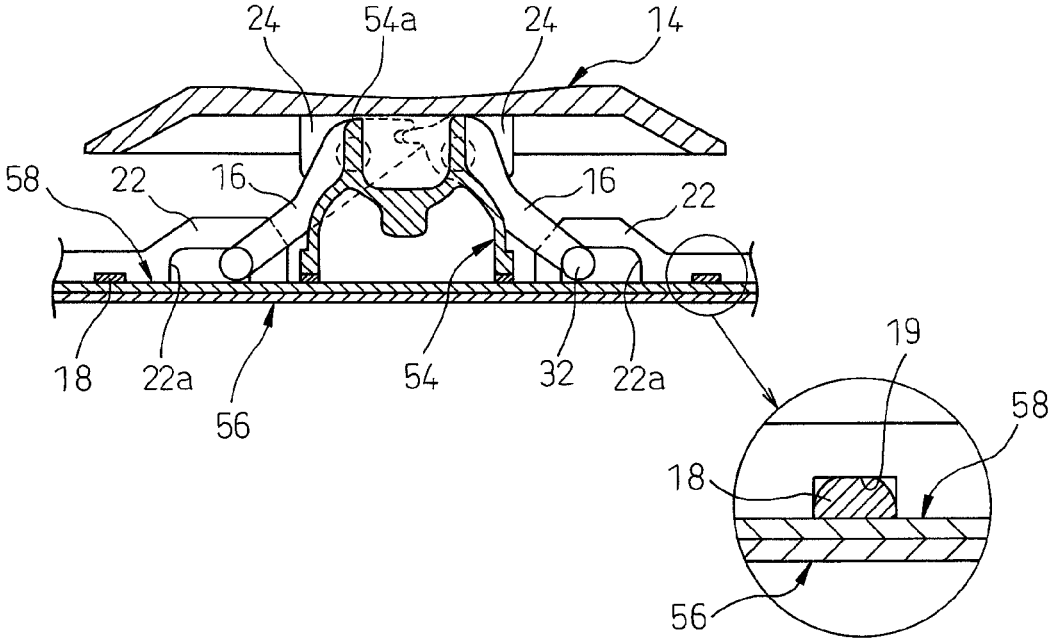
FIG. 3 is a sectional view along A-A line of FIG. 2.

FIGS. 1 to 3 show a key switch device according to a first embodiment of the invention. As shown in FIG. 1, a key switch device 10 has a switch panel 12; a key top 14 positioned above switch panel 12; a pair of link members 16 adapted to support key top 14 so that key top 14 may be moved in a vertical (up-and-down) direction; a membrane sheet 58 adapted to close and open a contact of an electric circuit corresponding to the vertical motion of key top 14; an actuating member 54 adapted to close the contact of membrane sheet 58 when being pressed by key top 14; and an elastic wall member 18 arranged on membrane sheet 58 in a frame-like shape around link members 16. In the embodiment, the pair of link members are explained as the gear-link-type, and actuating member 54 is explained as a rubber dome, which is a discrete component from membrane sheet 58. A lower end of rubber dome 54 is bonded to a surface of membrane sheet 58 by adhesive. Although silicon-type adhesive may be used as the adhesive for the rubber dome, another adhesive may be used.

Switch panel 12 is a frame-like member having a center opening 20 having a generally rectangular shape, the opening being covered by key top 14. On a lower side of switch panel 12, a groove 19 adapted to engage wall member 18 is formed (FIG. 3). On an upper side of switch panel 12, two pairs of (i.e., four) sliding guide parts 22 are arranged along a pair of opposing inner surfaces which delimit center opening 20. Each sliding guide parts 22 has a guide groove 22*a* to which a proximal end of each link member 16 slidably engages. On the proximal end of each link member 16, a pair of sliding shaft part 32, each adapted to engage each guide groove 22*a*, are formed. Each pair of sliding guide parts 22 are separated from each other in the sliding direction of link member 16. Siding shaft parts 32 of the proximal end of the pair of link members 16 are guided by sliding guide parts 22, whereby link members 16 may lie on switch panel 12 without overlapping on each other, when key top 14 is pressed down to the lowermost position thereof.

Key top 14 has a generally rectangular shape as seen in the vertical direction, and has two pairs of (i.e., four) shaft engaging parts 24, adapted to engage a distal end of link member 16, formed on lower side 14*b* opposed to upper side 14*a* (or the operation surface). Each shaft engaging part 24 has a shaft receiving hole 24*a*, and the distal end of each link member 16 rotatably engages shaft receiving hole 24*a*. Each pair of shaft receiving parts 24 are arranged side-by-side. Each shaft receiving part 24 is vertically arranged on lower side 14*b* of key top 14, and has a notch 24*b* communicated with shaft receiving hole 24*a*. A pivot shaft 34 of link member 16 rotatably engages shaft receiving hole 24*a* of shaft receiving part 24, whereby pair of link members 16*a* and key top 14 may be interlocked while key top 14 is vertically moved.

Link member 16 may be formed as a unified member by resin molding, and each link member has the same dimension and shape, wherein a tooth 36 of one link member rotatably engages a tooth 38 of the other link member when used. Link member 16 has a body part 30 and a pair of arm parts 26, 28 extending from both sides of body part 30 and parallel to each other. At the proximal end of link member 16, a slit 42 is formed between body part 30 and arm part 26, 28. The proximal end of each arm part 26, 28 may be elastically deformed so as to narrow a space delimited by slit 42, wherein a junction between body part 30 and each arm part 26, 28 functions as a fulcrum point for each arm part. Link member 16 is attached to switch panel 12 while arm parts 26, 28 deflect toward body part 30. Therefore, link member 16 is pressed against switch panel 12 due to elastic restoring force of each arm part 26, 28, whereby link member 16 is attached to switch panel 12 without a backlash between them.

Sliding shaft 32 is formed on the outer surface of the proximal end of each arm part 26, 28 so as to engage guide groove 22*a* of sliding guide 22 arranged at each corner of center opening 20 of frame-like switch panel 12. Two sliding shafts 32 of each link member 16 engage guide grooves 22*a* of opposing sliding guides 22, whereby link member 16 is slidably connected with switch panel 12. Sliding shaft 32 may horizontally slide along base 12 between both ends of guide groove 22*a*.

FIG. 3 shows the state wherein sliding shaft 32 is positioned at one end of guide groove 22*a* and link member 16 is raised. Link member 16 may reciprocate on switch panel 12 between both ends of guide groove 22*a*, whereby key top 14 may be vertically moved.

On the outer surface of the distal end extending from the proximal end of each arm part 26, 28, a pivot shaft 34, adapted to engage shaft receiving hole 24*a* of shaft receiving part 24 formed on lower side 14*b* of key top 14, is arranged. Two pivot shafts 34 of each member 16 engage opposing receiving holes 24*a*, whereby link member 16 may be pivotally connected to key top 14. When sliding shaft 32 of link member 16 is moved in the horizontal direction, pivot shaft 34 is moved in the vertical direction with key top 14, while key top 14 is maintained in the horizontal state relative to base 12 at a predetermined position.

Membrane sheet 58 in the embodiment is a flexible printed circuit (FPC) having three layers, including upper and lower sheeted substrates (not shown) each having an electrical contact on each opposing inner surface, whereby a sheet switch is constituted. Between the upper and lower sheeted substrates, a spacer (not shown), adapted to separate the two sheeted substrates by a certain distance so as to maintain the two electrical contacts in an opened state, is disposed. Membrane sheet 58 is supported on a support panel 56, and the two electrical contacts are positioned at generally the center of opening 20 of switch panel 12.

On the upper side of membrane sheet 58, wall member 18 is arranged around rubber dome 54, so as to make an endless loop along the contour of switch panel 12. As shown in FIGS. 2 and 3, wall member 18 is arranged in annular shape (or a frame shape in the embodiment), around pair of link members 16 and sliding guide part 22, within an interior area of key top 14. Non-limiting example of material of wall member 18 may be elastic adhesive, silicon rubber or elastic elastomer. Wall member 18 is fixed to membrane sheet 58 by adhesive or a double-sided adhesive tape. When elastic adhesive is used as wall member 18, wall member 18 may be formed by screen printing simultaneously with printing adhesive for rubber dome 54. In this case, the thickness or height of wall member 18 may be the same as the thickness of the adhesive for bonding lower side 54*b* of rubber dome 54 to membrane sheet 58, whereby wall member 18 may be formed in a single printing process. On the other hand, when the thickness of wall member 18 formed by screen printing should be larger than the thickness of the adhesive for rubber dome 54, wall member 18 may be formed by repeating the screen printing. Although there is no limitation on the thickness of wall member 18, it is preferable that the thickness be within 0.1 mm to 0.2 mm. It is necessary that wall member 18 contacts both opposing surfaces of switch panel 12 and membrane sheet 58, for example, wall member 18 is compressed in an annular groove (a frame-like groove in the embodiment) 19 of switch panel 12, as shown in FIG. 3. Due to this, the key-entry noise generated when key top 14 is pressed down is prevented from spreading to an exterior area of wall member 18. Further, due to the engagement between wall member 18 of membrane sheet 58 and groove 19 of switch panel 12, the thickness of unified membrane sheet 58 and switch panel 12 may be reduced, whereby the height of the key switch device may be reduced. Although there is no particular limitation on the width of wall member 18, it is necessary that the width be sufficiently large to bond wall member 18 to membrane sheet 18. When wall member 18 is formed by screen printing, the width of wall member 18 may be equal to the width of the adhesive for rubber dome 54.

Figure 4:
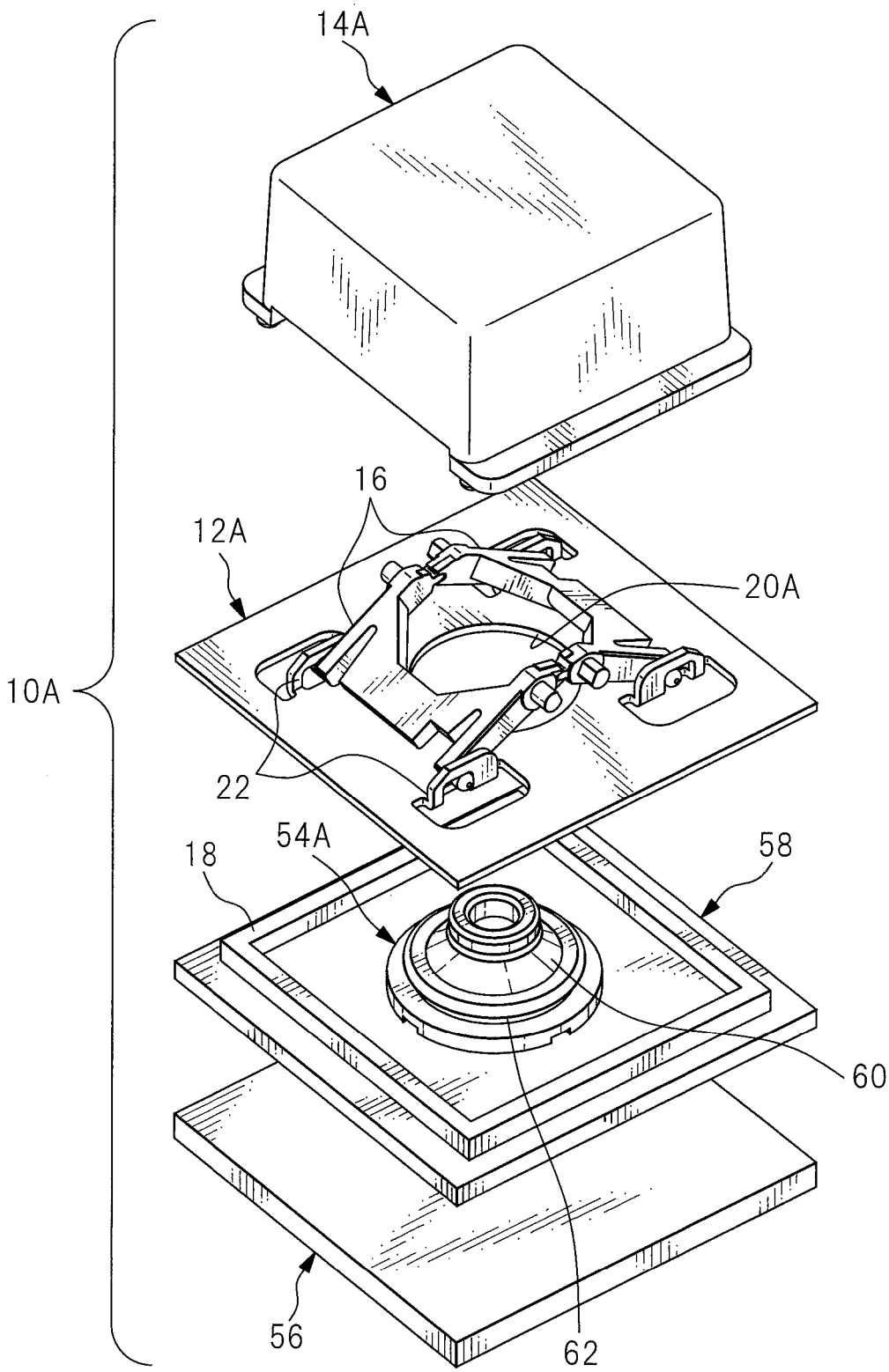
FIG. 4 is an exploded perspective view showing a key switch device according to a second embodiment of the present invention.
Figure 5:
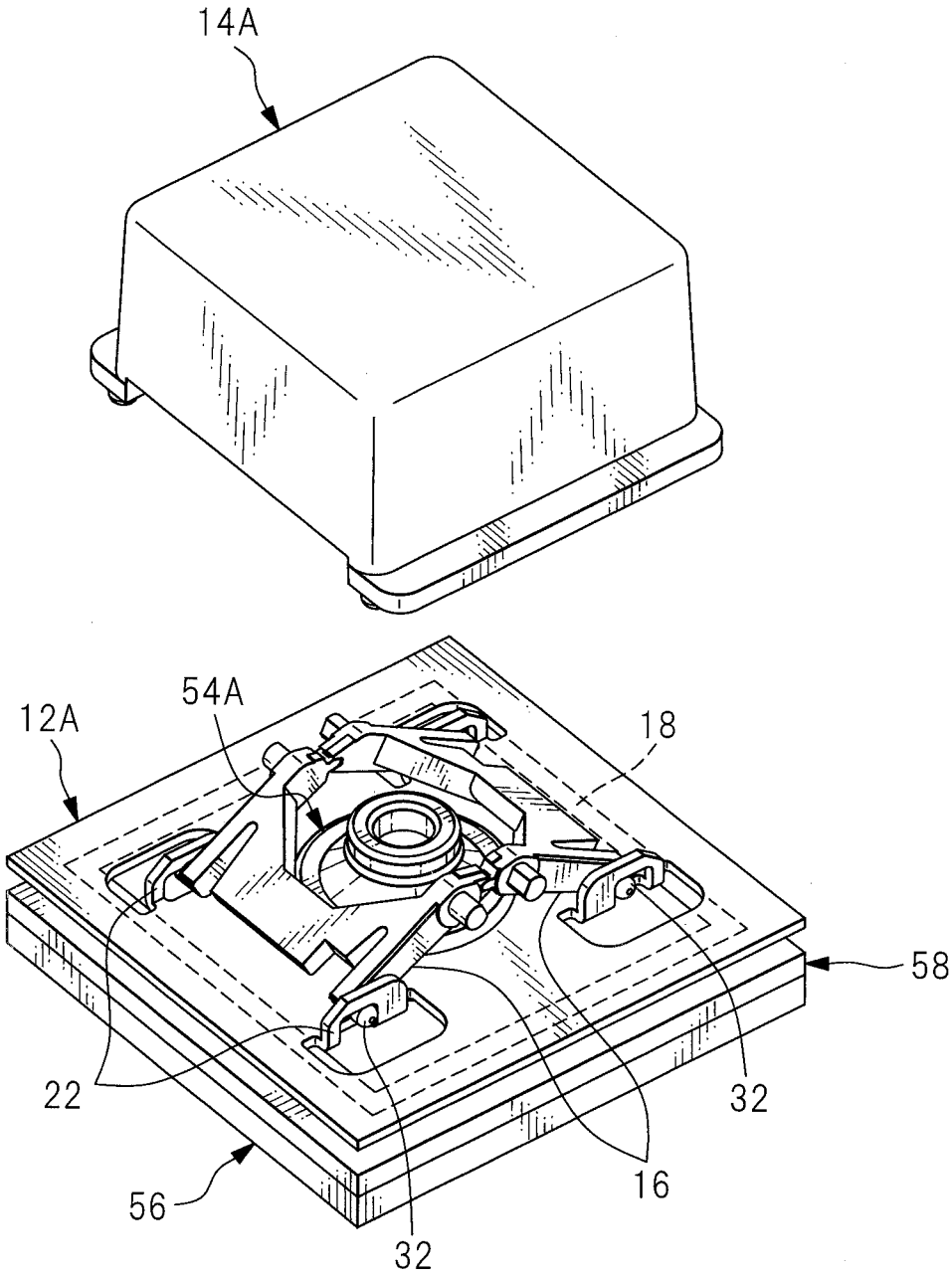
FIG. 5 is a perspective view showing the state wherein a key top is removed from the key switch device of FIG. 4.

In the first embodiment, wall member 18 of membrane sheet 58 is adapted to engage groove 19 of switch panel 12. However, in a second embodiment as shown in FIGS. 4 and 5, wall member 18 may be compressed between a flat surface of switch panel 12 and an opposing surface of membrane sheet 58, without forming a groove in switch panel 12.

Rubber dome 54 is disposed between key top 14 and membrane sheet 58, and is adapted to close and open the contacts according to the vertical movement of key top 14. Rubber dome 54 is formed as a unified dome shape from elastic material, and positioned in center opening 20 of switch panel 12 so that a top part 54*a* of rubber dome 54 is directed toward key top 14. An opened end 54*b* at the lower side of rubber dome 54 is bonded to the surface of membrane sheet 58 by adhesive.

The electrical contact supported between the pair of sheeted substrates is usually maintained in an open state by a spacer between the sheeted substrates. When key top 14 is pressed down, external force in the direction toward the sheeted substrates is applied to top part 54*a* of rubber dome 54, and then rubber dome 54 is deformed so as to press the upper sheeted substrate, whereby the electrical contact is closed.

In other words, in key switch device 10, when external force is not applied to key top 14, top part 54*a* of rubber dome 54 biases key top 14 to the uppermost position where is away from switch panel 12 in the vertical upward direction. At this time, the pair of contacts in membrane sheet 58 is opened. When key top 14 is pressed down by the key-entry operation of the operator, rubber dome 54 is deformed while applying upward elastic restoring force to key top 14, whereby rubber dome 54 presses the upper sheeted substrate so as to close the contact just before key top 14 reaches the lowermost position. When the pressing force to key top 14 is released, rubber dome 54 is elastically restored, whereby key top 14 is moved to the uppermost position and the upper sheeted substrate is restored so as to open the contact.

Next, a key switch device according to a second embodiment of the invention will be described. As shown in FIGS. 4 to 7, a key switch device 10A of the second embodiment is different from the first embodiment in that rubber dome 54A is attached to a circular opened edge of switch panel 12A and wall member 18 of membrane sheet 58 is compressed by a flat surface of switch panel 12A. The other configuration of the second embodiment may be common to that of the first embodiment, and thus the detailed explanation thereof is omitted.

Rubber dome 54A of the second embodiment has an outer groove 62 formed on a dome-shaped wall 60. Outer groove 62 of rubber dome 54A is engaged with circular opening 20A of switch panel 12A. Since the width of outer groove 62 is generally equal to or lower than the thickness of switch panel 12A, rubber dome 54A may be firmly fixed to opening 20A of switch panel 12A and correctly positioned relative to switch panel 12A in the thickness (vertical) direction. Further, since the outer dimension of groove 62 of rubber dome 54A generally equal to the inner dimension of opening 20A of switch panel 12A, when rubber dome 54A is attached to opening 20A, rubber dome 54A may be correctly positioned relative to switch panel 12A in the horizontal direction. Therefore, even when robber dome 54A and switch panel 12A are discrete components, rubber dome 54A and switch panel 12A may be easily and correctly positioned relative to each other, whereby key switch panel 10A may be easily assembled. In addition, although it is not necessary to bond the lower side of rubber dome 54A to the upper side of membrane sheet 58, the lower side of rubber dome 54A may be bonded to the upper side of membrane sheet 58 when switch panel 12A having rubber dome 54A attached thereto is stacked on membrane sheet 58. In other words, after rubber dome 54A is temporarily fixed to switch panel 12A, rubber dome 54A may be firmly fixed to membrane sheet 58.

Figure 6:
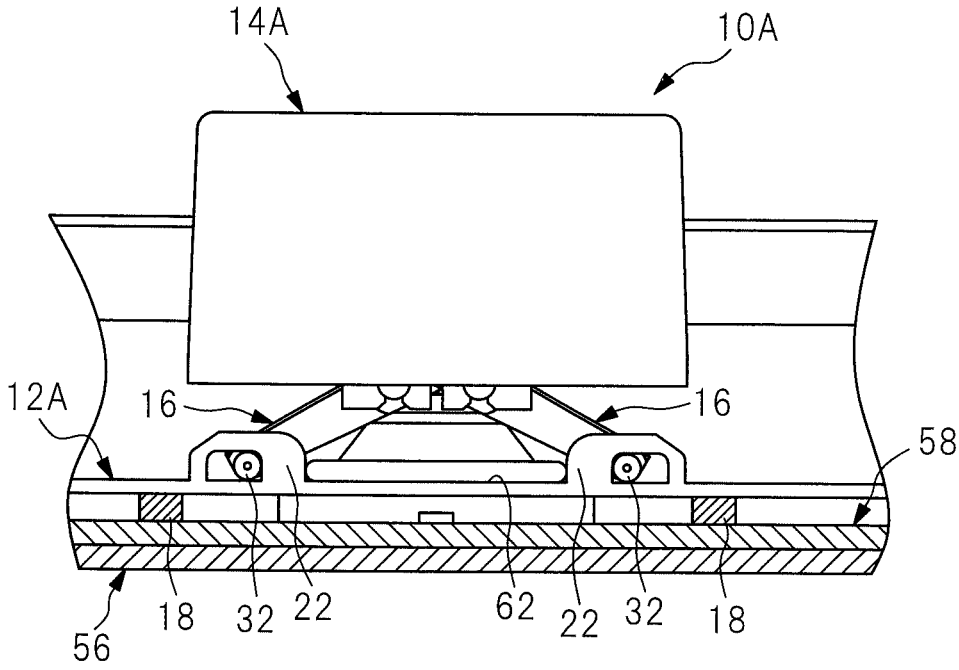
FIG. 6 is a sectional view of the key switch device of FIG. 4.

Similarly to the first embodiment, wall member 18 in the second embodiment may be formed on the upper side of membrane sheet 58 by screen printing or adhesives or the like. In the second embodiment, the lower side of switch panel 12A does not have a groove adapted to engage wall member 18, i.e., the lower side of switch panel 12A is a flat surface. Therefore, as shown in FIGS. 5 and 6, when key switch device 10A is assembled, wall member 18 is compressed between the upper side of membrane sheet 58 and the flat lower side of switch panel 12A. Due to this, the key-entry noise generated when key top 14A is pressed down is prevented from spreading to an exterior area of annular wall member 18. Further, due to the annular wall member 18, liquid is preventing from entering an inner area of wall member 18, whereby trouble of the contact of membrane sheet 58 and/or an electronic circuit within a housing (not shown) positioned below key switch device 10A, due to liquid, is avoided.

Figure 7:
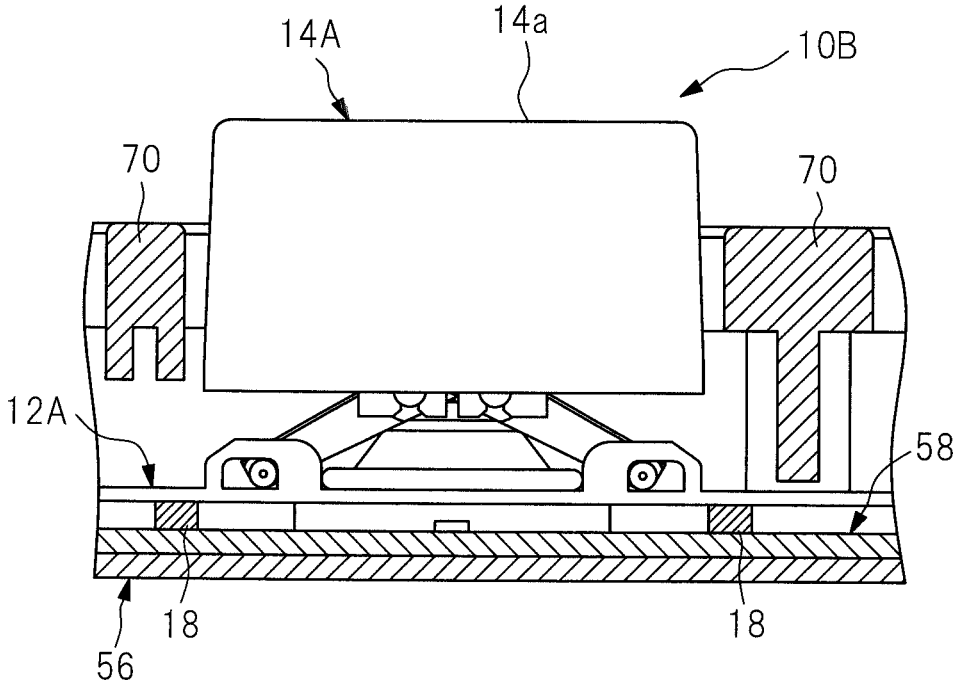
FIG. 7 is a sectional view of a modification of the key switch device of FIG. 4.
Figure 8:
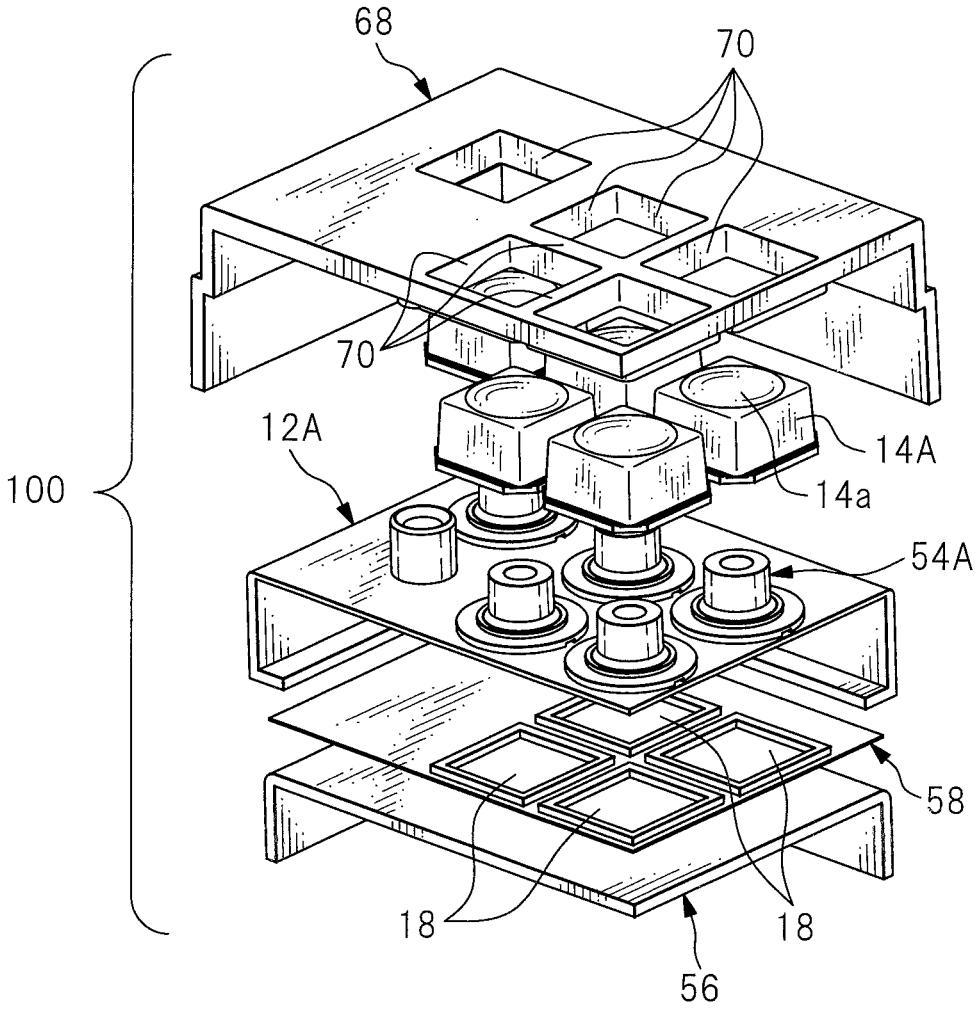
FIG. 8 is an exploded perspective view showing the key switch device of FIG. 7.
Figure 9:
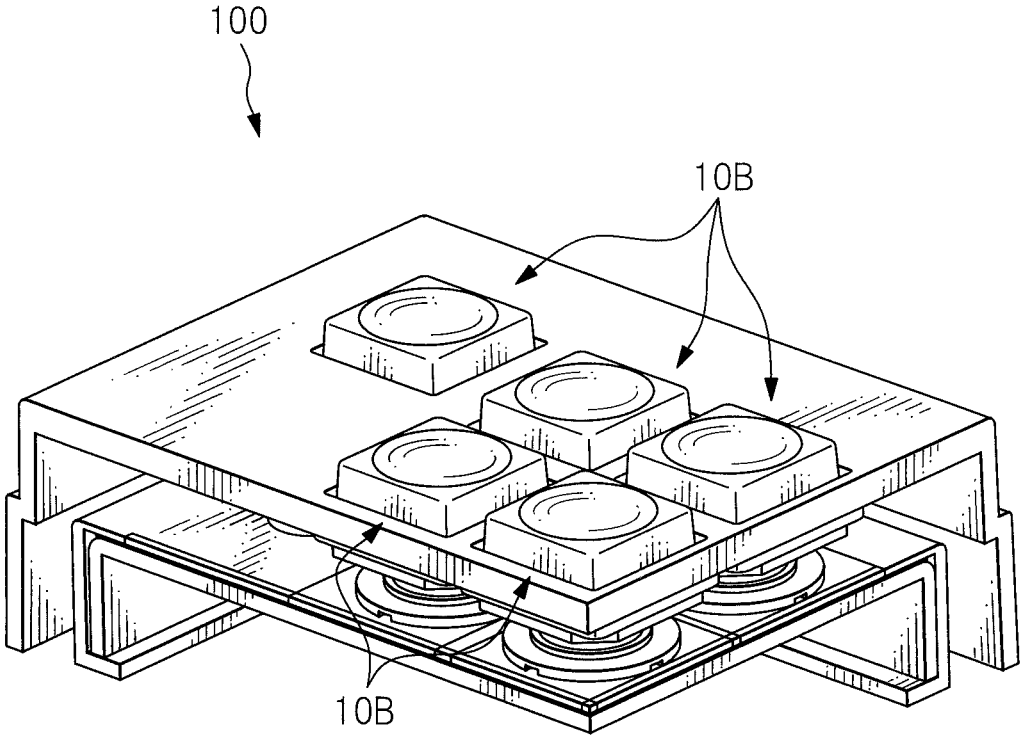
FIG. 9 is a perspective view showing the state wherein the key switch device of FIG. 8 is assembled.

FIG. 7 shows a modification of the second embodiment. In this modification, in order to improve the stability of the posture of key top 14A, a frame-like wall 70 is arranged around key top 14A and separated from the outer lateral surface of key top 14A by a predetermined distance. When key top 14A is pressed down, a finger of an operator may not always contact the center of an operation surface 14*a* of key top 14A, in other words, the finger may contact an edge of operation surface 14*a*. When the edge of operation surface 14*a* is pressed down by the finger, key top 14A may be moved downward while being inclined. However, by forming frame-like wall 70 around key top 14A so as to contact the outer lateral surface of key top 14A, the posture of inclined key top 14A may be corrected. As shown in FIGS. 8 and 9, frame-like wall 70 may be formed integrally with a cover 68 which is attached to the key top from above. In key switch device 10B according to the modification, the stability of posture of key top 14A may be improved due to cover 68 having frame-like wall 70, whereby the operability of key top 14A may be improved.

In the above embodiments, key switch devices 10, 10A and 10B are explained. However, the present invention is not limited to the embodiments, and the embodiments may be variously modified without changing the scope of the invention. For example, although the wall member is formed on the upper side of membrane sheet 58 in the embodiments, the wall member may be formed on the lower side of switch panel 12, 12A. Further, although one key switch device of the embodiments may be used alone, a keyboard having a plurality of key switch devices may be used, as shown in FIGS. 8 and 9.

In the key switch device or the keyboard of the invention, the wall member is disposed between the switch panel and the membrane sheet so as to contact both the opposing surfaces of the switch panel and the membrane sheet, and arranged along the contour of the key top. Therefore, the key-entry noise generated by key-entry operation to the key top is prevented from spreading around, the key-entry noise is prevented from rebounding between the switch panel and the membrane sheet, and liquid is preventing from entering an inner area of the wall member, whereby trouble of the contact of the membrane sheet due to liquid is avoided.

Due to the engagement between the wall member and the groove formed on the switch panel, the thickness of the unified membrane sheet and the switch panel may be reduced, whereby the height of the key switch device may be reduced.

When the wall member is formed by screen printing, the process for printing adhesive for the actuating member can be used to also form the wall member. Therefore, additional process is not necessary to form the wall member, whereby the wall member may be formed without increasing the cost.

When the groove of the outer wall of the actuating member engages the opening of the switch panel, the actuating member is properly positioned relative to the switch panel, whereby assembling of the key switch device may be facilitated. Further, the actuating member may be attached to the switch panel without using adhesive, the key switch device may be used in an oily environment without problems, whereby the key switch device or the key board may have a wide range of application.

When the frame-like wall is arranged around the key top so that the inner surface of the frame-like wall may contact the outer surface of the key top, the posture of inclined key top may be corrected, whereby the posture of the key top may be stabilized.

While the invention has been described with reference to specific embodiments chosen for the purpose of illustration, it should be apparent that numerous modifications could be made thereto, by one skilled in the art, without departing from the basic concept and scope of the invention.

The invention claimed is:

1. A key switch device comprising:

a switch panel;

a key top positioned above the switch panel;

a pair of link members positioned between the key top and the switch panel and adapted to support the key top so that the key top may be moved in a vertical direction while maintaining a horizontal posture;

a membrane sheet positioned below the switch panel and adapted to close and open a contact of an electric circuit corresponding to the vertical motion of the key top;

an actuating member positioned between the membrane sheet and the key top and adapted to close the contact corresponding to the downward motion of the key top; and an annular elastic wall member positioned between the switch panel and the membrane sheet, wherein the elastic wall member is formed on an upper side of the membrane sheet so as to be arranged along a contour of the key top, and is configured to contact a surface of the switch panel, the surface opposing the upper side of the membrane sheet.

2. The key switch device as set forth in claim 1, wherein the switch panel has a groove including the surface opposing the membrane sheet, the groove being adapted to engage the elastic wall member.

3. The key switch device as set forth in claim 1, wherein the elastic wall member is formed by screen printing.

4. The key switch device as set forth in claim 1, wherein the actuating member has a peripheral groove formed at a peripheral wall thereof, and the actuating member is attached to the switch panel by engaging the peripheral groove with an edge of an opening of the switch panel.

5. The key switch device as set forth in claim 1, further comprising a member including a frame-like wall arranged so as to surround the key top, the frame-like wall having an inner surface adapted to contact an outer lateral surface of the key top.

6. The key switch device as set forth in claim 1, wherein the surface of the switch panel is a flat surface contacting the elastic wall member.

7. A key board having a plurality of key switch devices the key board comprising a panel and a sheet, and each key switch device comprising:

a switch panel provided as a part of the panel of the key board;

a key top positioned above the switch panel;

a pair link members positioned between the key top and the switch panel and adapted to support the key top so that the key top may be moved in a vertical direction while maintaining a horizontal posture;

a membrane sheet provided as a part of the sheet of the key board, positioned below the switch panel and adapted to close and open a contact of an electric circuit corresponding to the vertical motion of the key top;

an actuating member positioned between the membrane sheet and the key top and adapted, to close the contact corresponding to the downward motion of the key top; and an annular elastic wall member positioned between the switch panel and the membrane sheet, wherein the elastic wall member is formed on an upper side of the membrane sheet so as to be arranged along a contour of the key top, and is configured to contact a surface of the switch panel, the surface opposing the upper side of the membrane sheet.

* * * * *